US008056725B2

(12) United States Patent
Doster

(10) Patent No.: US 8,056,725 B2
(45) Date of Patent: Nov. 15, 2011

(54) PRODUCT PACKAGE UTILIZING AN INFORMATION INDICATOR HELD IN A PRODUCT TRAY

(75) Inventor: Gary A. Doster, Orchard Park, NY (US)

(73) Assignee: Zippo Manufacturing Company, Bradford, PA (US)

( * ) Notice: Subject to any disclaimer, the term of this patent is extended or adjusted under 35 U.S.C. 154(b) by 175 days.

(21) Appl. No.: 12/701,321

(22) Filed: Feb. 5, 2010

(65) Prior Publication Data

US 2011/0192751 A1 Aug. 11, 2011

(51) Int. Cl.
*B65D 1/34* (2006.01)

(52) U.S. Cl. ..... 206/564; 206/85; 206/232

(58) Field of Classification Search ..... 206/85, 206/232, 557, 560–564, 459.5, 551; 220/495.01, 220/495.03, 23.83; 229/905, 906
See application file for complete search history.

(56) References Cited

U.S. PATENT DOCUMENTS 2,778,487 A * 1/1957 Raeburn ..... 206/459.5
3,682,298 A 8/1972 Guillerm
3,690,450 A 9/1972 Sheldon
4,132,311 A * 1/1979 Glinert ..... 206/564
5,119,940 A * 6/1992 Grindrod ..... 206/564
5,617,628 A 4/1997 Harder et al.
6,123,200 A 9/2000 Stephens et al.
6,149,006 A * 11/2000 Brauner et al. ..... 206/551
6,155,446 A * 12/2000 Alexander et al. ..... 220/23.91
6,631,804 B2 10/2003 Wong
7,011,215 B2 * 3/2006 Meissen et al. ..... 206/557
7,717,323 B2 * 5/2010 Kim ..... 229/162.1
2008/0202976 A1 * 8/2008 Burgess et al. ..... 206/558

OTHER PUBLICATIONS

PCT/US11/23820,International Search Report and Written Opinion of the International Searching Authority dated Apr. 5, 2011.

* cited by examiner

*Primary Examiner* — Luan K Bui
(74) *Attorney, Agent, or Firm* — Baker & McKenzie LLP

(57) ABSTRACT

A product package having a product tray and an information indicator that can be mounted in the tray. The information indicator is operable to be held in the product tray and the product placed into the tray on top of the information indicator. The tray is operable to protect the product from damage during storage or transport as well as provide an enhanced appearance during display. The information indicator is operable to convey information to the consumer as well as assist in removal of the product from the product tray.

11 Claims, 10 Drawing Sheets

PRODUCT PACKAGE UTILIZING AN INFORMATION INDICATOR HELD IN A PRODUCT TRAY

TECHNICAL FIELD

The present application is generally directed to a product package, specifically a package and display unit having a tray operable to incorporate an information indicator.

BACKGROUND

Product packaging is a field with many variances on the type of packaging that benefits the product and the consumer most. Product packaging can be an important factor in the decision of the consumer to choose a particular product. Product packaging can affect the decision of a consumer by gaining the attention of the consumer and perhaps providing information to the consumer about product features. This informational aspect of product packaging can be provided by an information indicator in combination with the packaging itself. An additional benefit of product packaging is to protect the product from damage during display or transport. It is desirable to provide packaging that is easy to use while providing a sufficient level of protection. This ease of use often requires uncomplicated placement and removal of the product to or from the package. A product package that performs a combination of all of these functions is highly desirable.

Specifically, with reference to a product such as a lighter, it is desirable to present the product to the consumer such that the attention of the consumer is captured and information about the product or related products is readily conveyed, while at the same time providing protection for the product in a secure package.

BRIEF SUMMARY

The present application relates to an apparatus for storage and display of a device, the apparatus comprising a tray with a recessed portion defined therein, wherein the dimensions of the recessed portion substantially correspond to the dimensions of the device, such that the device may be securely placed in the recessed portion for storage or display. The apparatus further comprises an information indicator that can be coupled to the recessed portion, wherein a first portion of the information indicator is disposed within the recessed portion of the tray, and a second portion of the information indicator extends outside of the recessed portion of the tray.

Further disclosed is a product package operable to store and display a device, comprising a tray having a recessed portion defined therein, the recessed portion comprising a bottom surface, first and second sidewalls extending orthogonally from opposite side portions of the bottom surface, the first and second sidewalls having a height equal to or greater than the thickness of the device, and first and second end walls extending from opposite end portions of the bottom surface, wherein the first and second end walls each connect the first and second sidewalls and have an interior surface that extends angularly from the bottom surface, such that the interior surface has a trapezoidal shape.

Additionally disclosed is a product package operable to store and display a device, comprising a tray having a top surface, a primary recessed portion defined in the tray for receiving the device, the primary recessed portion having a recessed floor, and secondary recessed portions defined in the tray, wherein the secondary recessed portions comprise a further recessed area defined in the recessed floor of the primary recess portion and first and second recessed surface areas defined in the top surface of the tray. The apparatus further comprises an information indicator that can be coupled to the tray, wherein the information indicator comprises a folded portion and flap portions connected to the folded portion, wherein the folded portion of the information indicator can be placed within the further recessed area of the secondary recessed portions, and the flap portions of the information indicator can be placed in the recessed surface areas of the tray.

BRIEF DESCRIPTION OF THE DRAWINGS

For a more complete understanding of the features and advantages of the present application, reference is now made to the detailed description along with the accompanying figures and in which.

DETAILED DESCRIPTION

Figure 1:
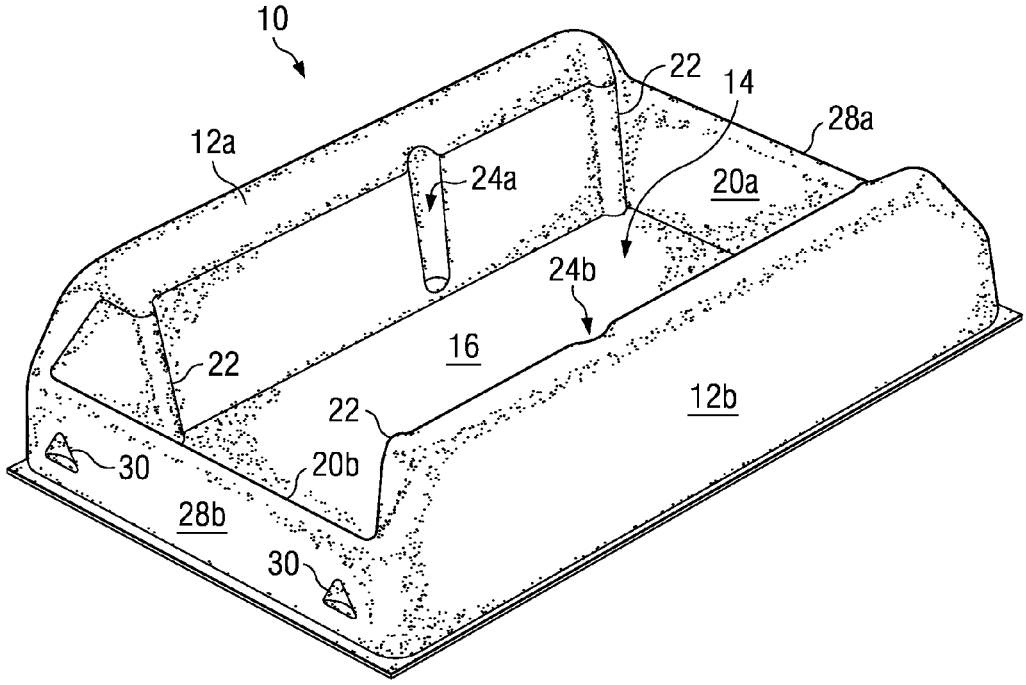
FIG. 1 is a perspective view of a first embodiment of the tray of the present application.

In the illustrations given, and initially referencing FIGS. 1-7, the reference numeral 10 designates a first embodiment of a tray that can be used to hold an information indicator and a product or device (not shown) to be stored or displayed. This particular embodiment of the tray 10 is suitable for storing and displaying a rectangular-shaped product such as a lighter.

The tray 10 is generally composed of a single piece of a molded, semi-rigid material, such as plastic. In some embodiments, however, the tray 10 can be constructed of components that are releasably coupled. The top side of the tray 10 can be covered in a soft [pliable?] material, such as velvet, cloth, or felt, in order to prevent damage to the product as well as to enhance the aesthetics of the tray 10 for displaying the product. The soft material covering can also have the benefit of providing a more secure fit when the product is placed in the tray 10.

Referring to FIG. 1, this embodiment of the tray 10 is shown to have two sidewalls 12*a* and 12*b*. These two sidewalls are on opposite sides of a recessed portion 14. The recessed portion 14 is dimensioned to substantially match the dimensions of the product or device to be stored or displayed in the tray 10 and is defined by a recessed floor 16, the two similarly-dimensioned, sidewalls 12*a* and 12*b* on opposite sides of the recessed floor 16 and two similarly-dimensioned outwardly-sloped end walls 20*a* and 20*b* on opposite ends of the recessed floor 16. The end walls 20*a* and 20*b* extend angularly from the recessed floor, and therefore take on a trapezoidal shape as the width of the end wall increases as the end wall rises from the recessed floor upward. In some embodiments, the end walls are vertical and may have a rectangular shape. In some embodiments, at either ends of the sidewalls 12*a* and 12*b* there is a ridge 22 protruding from the recessed portion 14 that allows for more secure placement of the product in the tray 10. These protruding ridges 22 help prevent the product or device from sliding or shifting when it is held by the tray. Some embodiments of the tray also include grooves 24*a* and 24*b* in the sidewalls 12*a* and 12*b* that allow for the insertion of a removal tool that operates to assist the removal of the product from the tray 10.

Still referring to FIG. 1, the exterior of the tray 10 is defined by the two sidewalls 12*a* and 12*b* and two exterior end walls 28*a* and 28*b*. In some embodiments, the length and width of the tray 10 are such that the tray 10 will fit into a rectangular box, which can be covered for storage or left uncovered for display. Thus the length and width of the tray 10 may be slightly smaller than the length and width of the box to allow the tray 10 to fit inside of the box. In some embodiments, the box consists of a bottom portion and a top portion, or in other embodiments includes only a single portion. In the case that the box has a top and bottom portion, the tray 10 is placed into the bottom portion of the box. The top portion of the box may be placed onto the bottom portion to form an enclosure around the tray 10. In this configuration the enclosed box is suitable to transport the product.

In some embodiments, the exterior end walls 28*a* and 28*b* of the tray 10 include one or more indentations 30, defined therein, which allow the use of a placement or removal tool that is operable to assist in the removal or placement of the tray to or from the box. In other embodiments these indentations 30 could also be defined in the exterior of the sidewalls 12*a* and 12*b* in addition to or in replacement of their location in the exterior end walls 28*a* and 28*b*.

Figure 2:
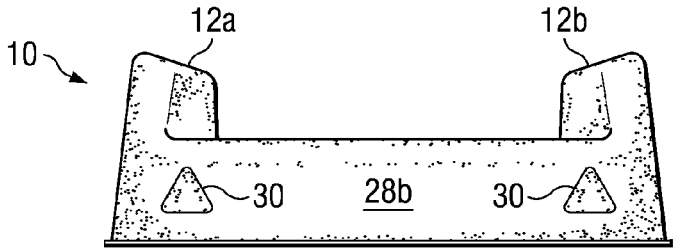
FIG. 2 is an end view of the tray of FIG. 1.

FIG. 2 shows an end view of the tray 10 as it would appear in some embodiments. This view further shows the existence of the indentations 30 on the exterior end wall 28*b*. Due to the symmetrical characteristics of this particular embodiment, this view would be similar if looking at the opposite end showing exterior end wall 28*a*. Note that in this embodiment the height of the exterior end wall 28*b* is less than the height of sidewalls 12*a* and 12*b*. This configuration allows for an information indicator 60 (described further below) to be placed into the tray 10 and extend beyond the end walls 20*a* and 20*b* of the tray 10. The portions of the information indicator 60 that extend beyond the end walls 20*a* and 20*b* of the tray 10 can be easily grasped, making removal of the indicator 60 from the tray 10 easier. Additionally, if the product is placed into the tray 10 on top of the information indicator 60, the product can also be more easily removed from the tray by grasping the portion of the indicator extending beyond the end walls 20*a* and 20*b* of the tray 10 and lifting upwards, thus eliminating the need to use a removal tool or turning the tray 10 upside-down to remove the product.

Figure 3:
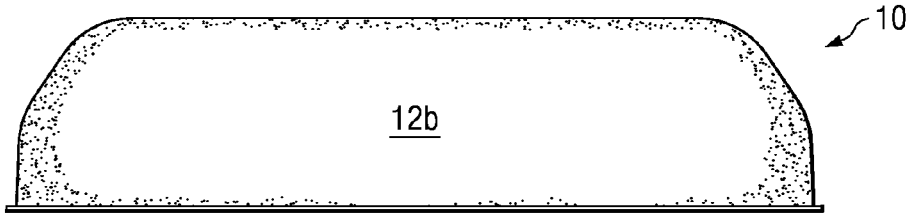
FIG. 3 is a side view of the tray of FIG. 1.

FIG. 3 illustrates a side view of the tray 10 as it would appear in some embodiments. This side view shows the sidewall 12*b*. In this embodiment the length and height of the sidewalls 12*a* and 12*b* are greater than or equal to the length and depth, respectively, of the product to be stored or displayed in the tray 10. This provides for greater protection of the product from damage when it is held in the tray 10. Again, due to the symmetry of the tray in this particular embodiment, this view would be similar if looking at the opposite side showing sidewall 12*a*.

Figure 4:
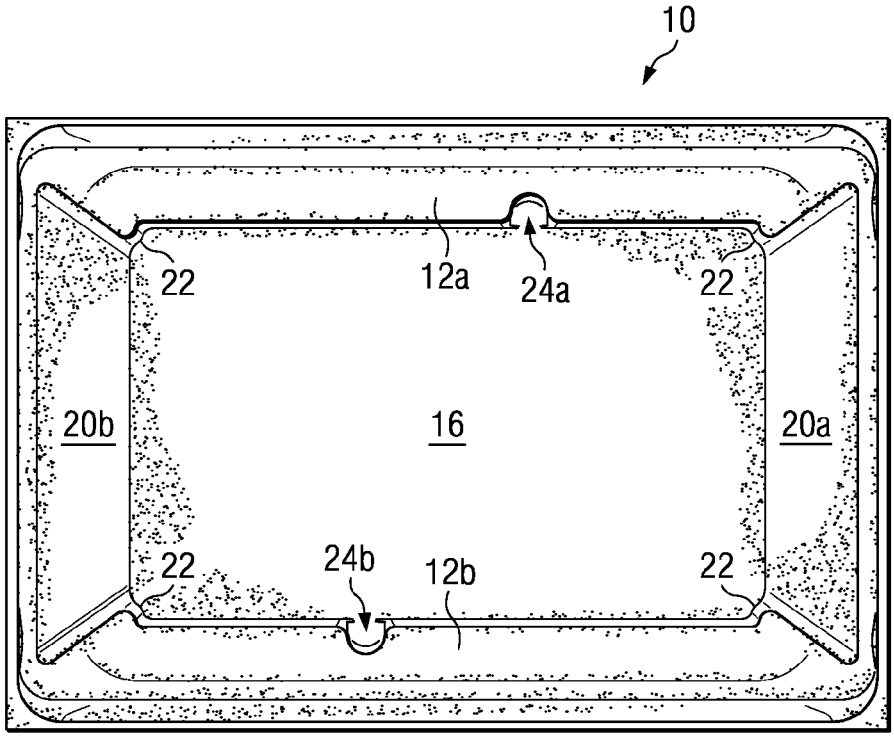
FIG. 4 is a plan view of the top of the tray of FIG. 1.

FIG. 4 is a plan view of the top of the tray 10. This view illustrates the rectangular shape of the tray 10 and the corresponding rectangular shape of the recessed floor 16. The rectangular shape of the recessed floor 16 in this embodiment would correspond to a rectangular-shaped device to be held in the tray 10. The dimensions of the recessed floor 16 are such that the device to be stored or displayed in the tray 10 will cover most or all of the recessed floor 16 when placed into the tray 10. In some embodiments, the protruding ridges 22 are operable to hold the product in the tray 10 such that the product fits securely in the tray 10. The protruding ridges 22 are further operable to minimize sliding or movement of the product once it is placed into the tray 10. The grooves 24*a* and 24*b*, included in some embodiments, appear in this view as cut-outs in the interior of sidewalls 12*a* and 12*b* and allow the insertion of a removal tool between the tray and the product to assist in the removal of the product from the tray 10. In some embodiments, the trapezoidal shape of the end walls 20*a* and 20*b* shown here will match the shape of the end tabs 64*a* and 64*b* of particular embodiments of the information indicator 60.

Figure 5:
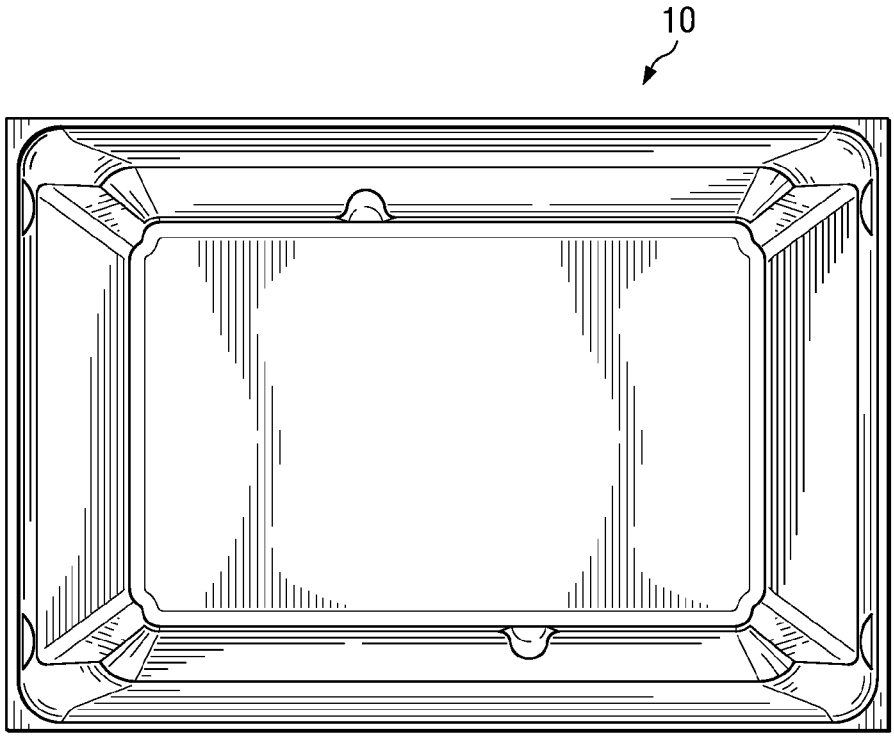
FIG. 5 is a plan view of the bottom of the tray of FIG. 1.

FIG. 5 is a plan view of the bottom of the tray 10. As is shown in this illustration, it is not necessary that the pliable material, such as cloth or felt, that covers the top side of the tray covers the bottom side as well. One advantage of the pliable material covering is to protect the product from damage as well as enhance the appearance of the tray 10 for display. It may not be as advantageous to cover the bottom side in the same soft material as the top side of the tray 10 in some embodiments since the product does not contact the bottom side when placed into the tray 10, and since the bottom side is not visible when the product is displayed in the tray 10. FIG. 5 also illustrates that the tray 10 can be a hollow, molded piece of semi-rigid material. In some embodiments the tray 10 can be a solid piece of material, however, the hollow configuration that is illustrated by this embodiment in FIG. 5 provides the benefits of a reduced weight and lower material costs. It is to be appreciated that the tray 10 can be molded into various shapes and forms, depending on the shape of the product to be held in the tray 10. For example, the tray 10 may be circular, octagonal, or oval in shape to match a device of approximately the same shape.

Figure 6:
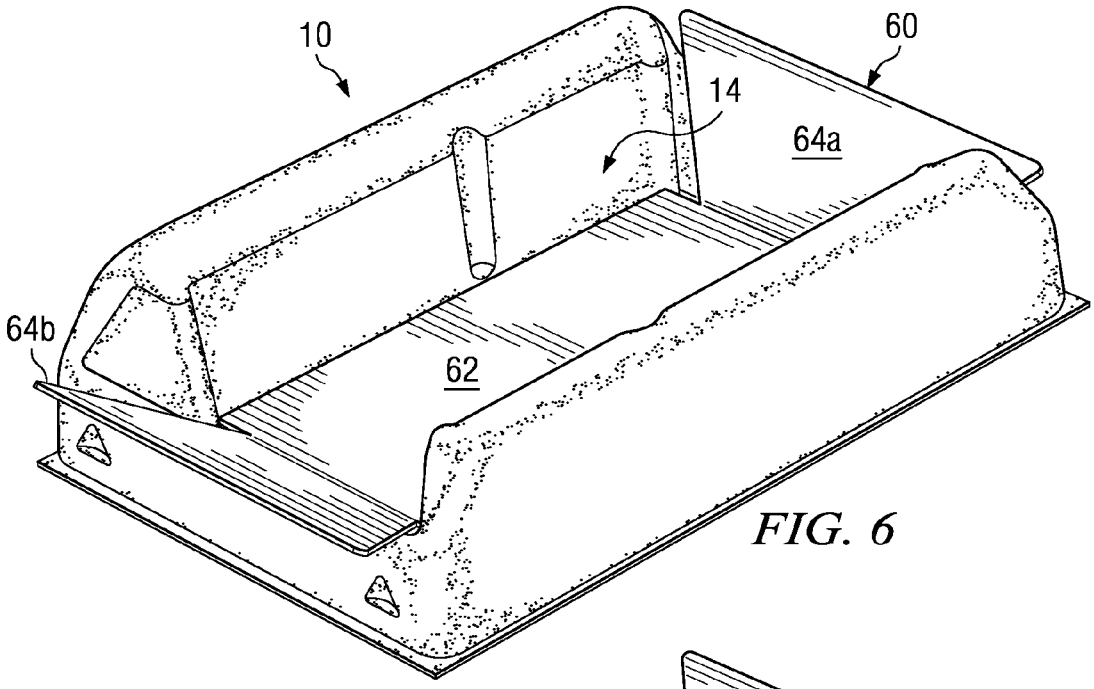
FIG. 6 is a perspective view of the tray of FIG. 1 holding a first embodiment of the information indicator of the present application.

FIG. 6 is a perspective view of the tray 10 holding a first embodiment of the information indicator 60. In some embodiments, the information indicator 60 is comprised of a middle rectangular section 62 and two end tabs 64*a* and 64*b*. In some embodiments, the middle rectangular section 62 and the two end tabs 64*a* and 64*b* are constructed of a single piece of foldable-material, capable of displaying information. Such material can be paper-based, such as cardboard, or could also be a plastic or plastic-like substance. A crease may be located at the shared side of each end tab and the middle rectangular section 62. This allows for the end tabs 64*a* and 64*b* to be folded upward to match the incline of the end walls 20*a* and 20*b*. In this embodiment, the middle rectangular section 62 of the indicator is sized to substantially match the dimensions of the recessed floor 16 of the tray 10. This allows for a secure fit of the information indicator 60 into the recessed portion 14. In some embodiments, the trapezoidal shape of the end tabs 64*a* and 64*b* substantially match the trapezoidal shape of the interior end walls 20*a* and 20*b* of the tray 10. The size of the tabs in some embodiments are such that each tab 64*a* and 64*b* extends beyond the length of the end walls 20*a* and 20*b*. As explained when referring to FIG. 2, the portions of the end tabs 64*a* and 64*b* which extend beyond the ends of the end walls 20*a* and 20*b* can be easily grasped, making removal of the indicator 60 from the tray 10 easier. Additionally, if the product is placed into the tray 10 on top of the information indicator 60 the product can also be more easily removed from the tray 10 by grasping the portion of one or both of the end tabs 64*a* and 64*b* extending beyond the end walls 20*a* and 20*b* and lifting upwards, thus eliminating the need to use a removal tool or the need to turn the tray 10 upside-down to remove the product. Referring again to FIG. 6, the product to be displayed or stored in the tray 10 could be placed into the recessed portion 14 of the tray 10 on top of the information indicator 60.

Figure 7:
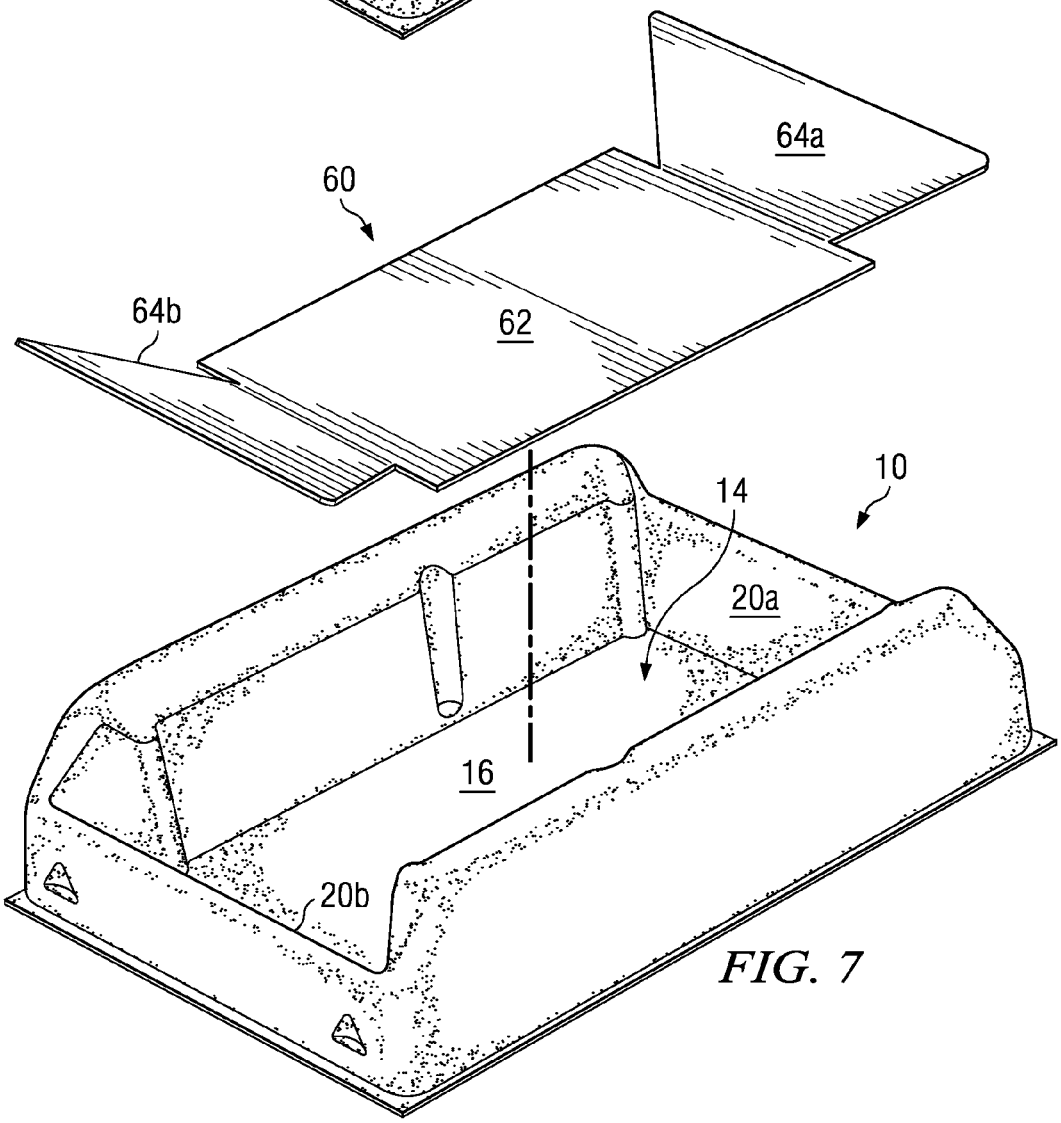
FIG. 7 is an exploded view of the information indicator and the tray of FIG. 6.

FIG. 7 illustrates an exploded view of the information indicator 60 removed from the tray 10. The figure shows how the indicator 60 is inserted into the recessed area 14 of the tray 10 placing the middle rectangular section 62 of the indicator 60 over the recessed floor 16. The end tabs 64*a* and 64*b* of the indicator 60 would be placed over the end walls 20*a* and 20*b* respectively.

The information indicator 60 can serve the purpose of allowing easier removal of the product from the tray 10 as explained in reference to FIG. 6. In some embodiments, the information indicator 60 can also serve to provide information to the consumer. All sections of the information indicator 60 can be printed with information or images useful to the consumer such as the manufacturer name or logo, product name or logo, product features, and advertisements. One of the benefits of the configuration of the indicator 60 in this embodiment is that any information printed on end tabs 64*a* and 64*b* is still visible when the product is placed into the tray 10 on top of the indicator 60 and can therefore convey a message or information to the viewer with the product still in the tray. The visibility of the end tabs 64*a* and 64*b* is due to the inclined configuration of interior end walls 20*a* and 20*b*. Their incline allows the end tabs 64*a* and 64*b* to be viewable from above the tray 10 while at the same time securing the product and indicator 60 in the tray 10.

FIGS. 8-18 illustrate a second embodiment of the present disclosure. This embodiment is suitable for the display and storage of an elongated product such as an elongated lighter or a writing instrument.

Figure 8:
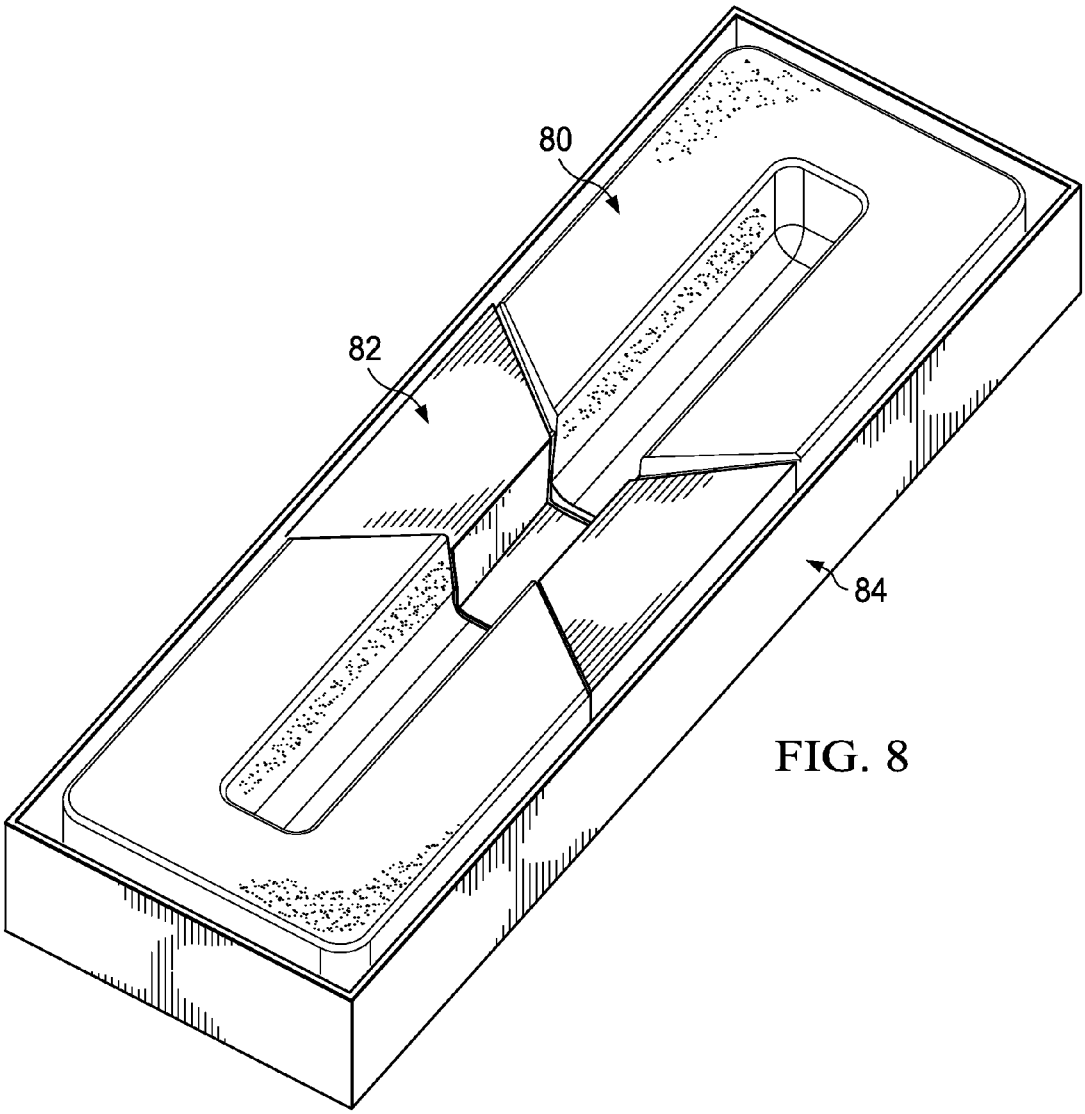
FIG. 8 is a perspective view of a second embodiment of the tray of the present application.

Referring to FIG. 8, this embodiment is comprised of tray 80 information indicator 82 and box 84. Indicator 82 is shown here inserted into tray 80. And tray 80 is shown held by box 84.

Figure 9:
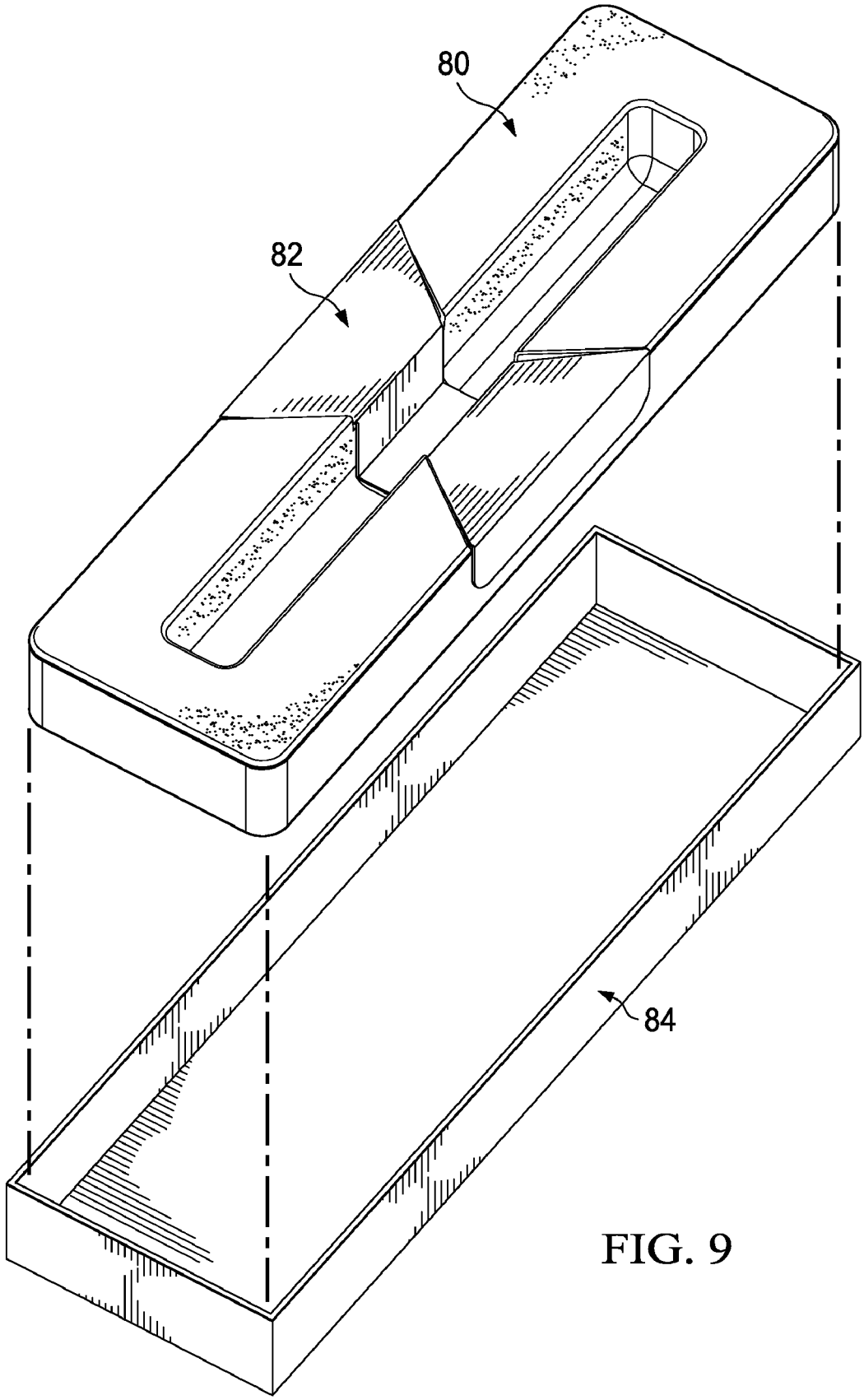
FIG. 9 is an exploded view of the tray and box illustrated in FIG. 8.

FIG. 9 illustrates the removal of the tray 80 from the box 84. In this embodiment, the dimensions of the box 84 are such that tray 80 fits securely inside the walls of the box 84.

Figure 8A:
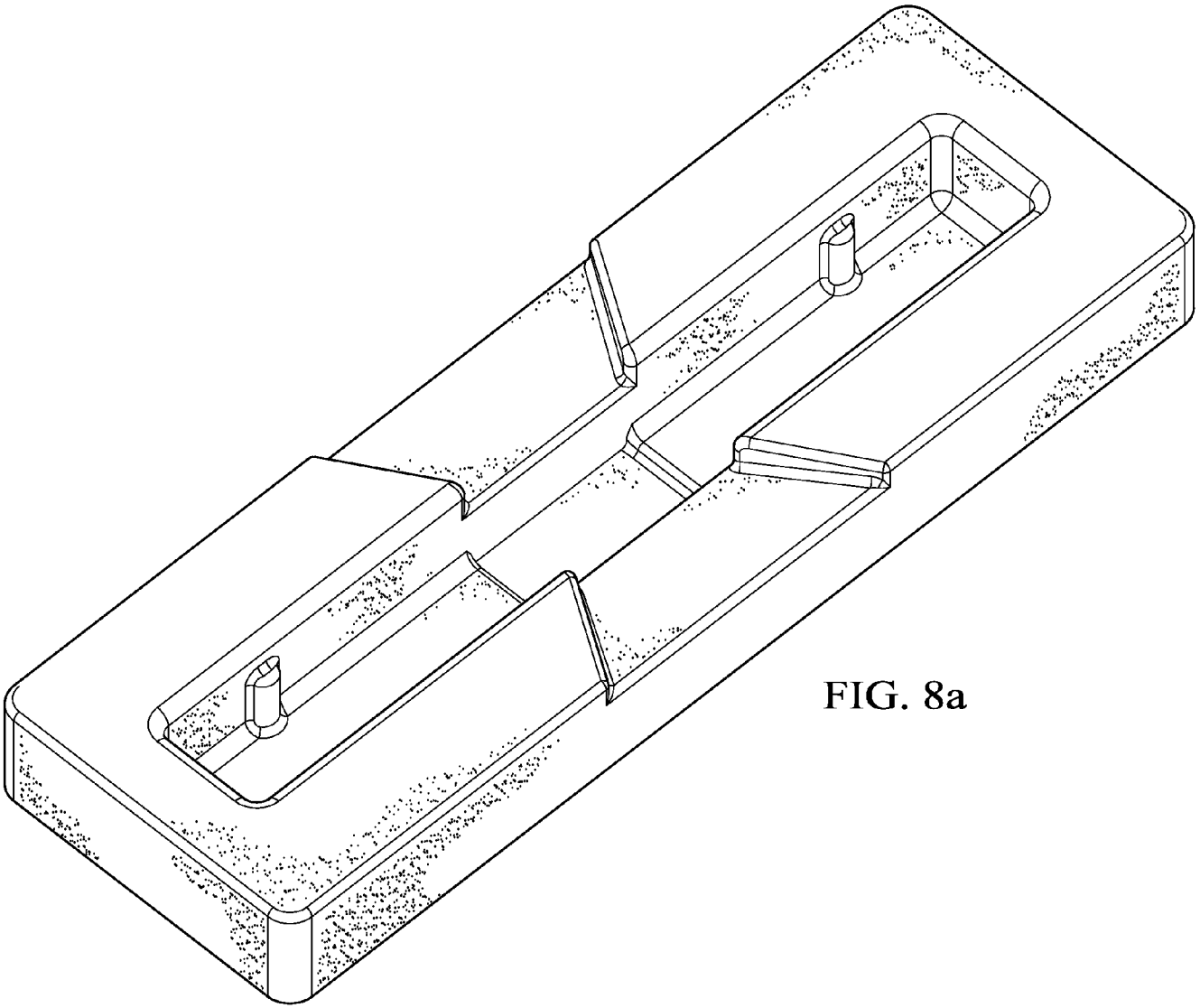
FIG. 8*a* is a perspective view of an exemplary embodiment of a tray having male detents, in accordance with the present disclosure.
Figure 10:
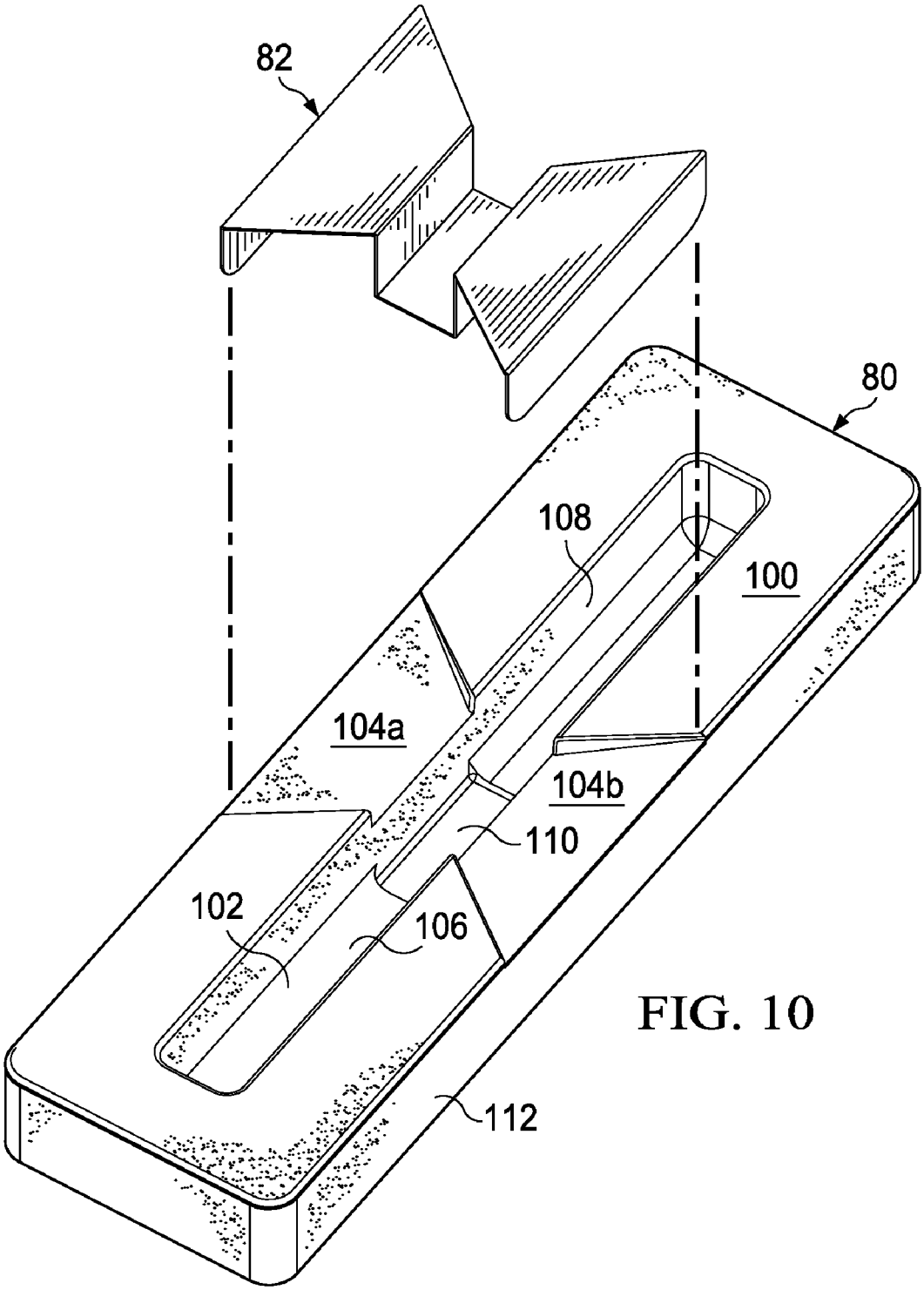
FIG. 10 is an exploded view of the tray and an embodiment of the information indicator illustrated in FIG. 8.

FIG. 10 illustrates the information indicator 82 removed from the possession of the tray 80. This embodiment of the tray 80 has a top surface 100 which surrounds a primary recessed portion 102. The top surface 100 also has two recessed surface areas 104*a* and 104*b*, defined therein, that correspond to the placement location of a portion of the information indicator 82 when the indicator 82 is held by the tray 80. In an alternative embodiment, the two recessed surface areas 104*a* and 104*b* may have a rectangular shape rather than a trapezoidal shape, as shown in FIG. 10. In addition, the depth of the two recessed surface areas 104*a* and 104*b* may be uniform between the primary recessed portion 102 and the exterior wall 112 of the tray 80. The primary recessed portion 102 of the tray comprises a recessed floor 106 and an interior wall 108 surrounding the recessed floor 106 and extending vertically between the recessed floor 106 and the top surface 100. Although the primary recessed portion 102 in FIG. 10 is depicted as having a rectangular cross-section profile, the primary recessed portion 102 may have an tapered cross-sectional profile such that the width of the primary recessed portion 102 is smaller at the bottom than at the top. A representative example of a tray 80 with a tapered cross-section is shown in FIG. 18*a*. This embodiment would provide additional security against movement of a device placed in the primary recessed portion 102. In another alternative embodiment, male detents can be placed on the interior walls 108 of the recessed portion 102 to further secure the device against movement. A representative example of a tray 80 with male detents is shown in FIGS. 8*a* and 16*a*.

The recessed floor 106 has a further recessed area 110, defined therein, that is slightly recessed from the floor level of the recessed floor 106. The secondary recessed portions, which includes the further recessed area 110 and the two recessed surface areas 104*a* and 104*b*, correspond to the location into which the indicator 82 is held in the tray 80. The dimensions and shape of the further recessed area 110 and the two recessed surface areas 104*a* and 104*b* correspond to the dimensions and shape of the indicator 82 such that portions of the indicator 82 rest within the corresponding recessed area when the indicator 82 is placed into the tray 80. In some embodiments, the dimensions of the primary recessed portion 102, defined by a length, width and a depth, substantially match the dimensions of the product to be stored or displayed in the tray 80, also defined by a length, width and depth. In some embodiments, the tray 80 is further comprised of an exterior wall 112 that extends vertically from the outer edge of the top surface 100 and surrounds the tray 80 on all sides. In such embodiments, the depth of the exterior wall 112 is equal to or greater than the depth of the recessed portion 102.

The advantage of this embodiment of the disclosure as shown in FIG. 10 is that the information indicator 82 can be placed into the recessed portions of the tray 80 and held in place. The product can then be placed into the primary recessed portion 102 of the tray 80 on top of the indicator 82. The product is held securely in place in the tray 80 for storage or display. The information indicator 82 serves functionally to facilitate easy removal of the product from the tray 80. When the product is placed into the tray 80 on top of the indicator 82, the product can be easily removed by grasping the indicator 82 at one or more points and lifting upwards on the indicator 82 to remove both the indicator 82 and the product from the tray 80. In some embodiments, the tray 80 will be covered in a pliable material, such as cloth or felt, to prevent damage to the product and enhance the aesthetic appearance of the tray 80 for display of the product.

Figure 11:
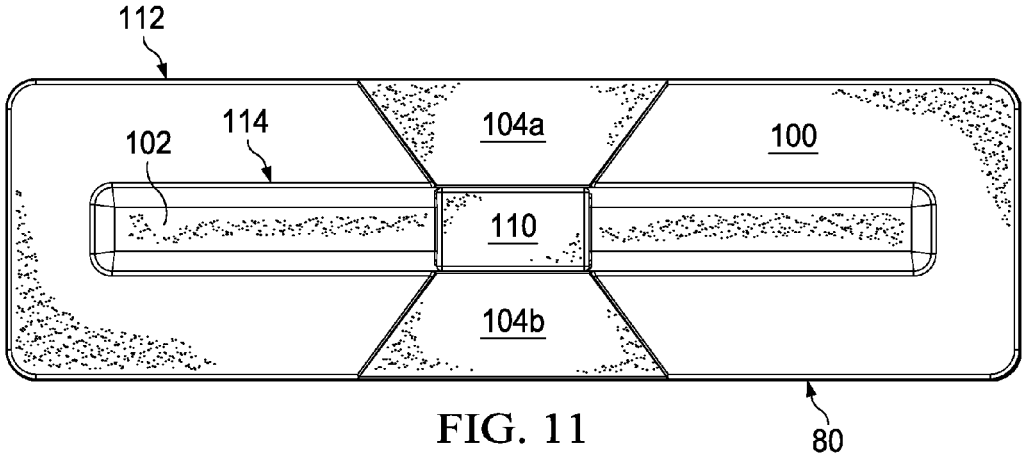
FIG. 11 is a plan view of the top of the second embodiment of the tray.

FIG. 11 illustrates a plan view of the top of tray 80. This view further illustrates how the top surface 100 surrounds the primary recessed portion 102. In some embodiments, the length and width of the tray 80, and therefore the top surface 102, exceed the length and width of the product to be placed into the tray 80. FIG. 11 also illustrates how the recessed surface areas 104*a* and 104*b* span from the outer edge 112 of the top surface 100 to the inner edge 114 of the top surface 100. In some embodiments, the shape and dimensions of the recessed surface areas 104*a* and 104*b* and the further recessed area 110 substantially match the shape and dimensions of the portions of the indicator 82 to be held in the tray 80. In this embodiment, the recessed surface areas 104*a* and 104*b* have a trapezoidal shape to match the trapezoidal shape of the portion of the information indicator 82 that rests in the recessed surface areas. When the information indicator 82 is placed into the tray 80, the recessed surface areas 104*a* and 104*b* and the further recessed area 110 serve to assist in holding the information indicator 82 in place and preventing it from shifting or sliding.

Figure 12:
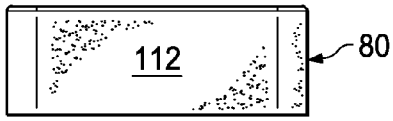
FIG. 12 is an end view of the tray of FIG. 11.
Figure 13:
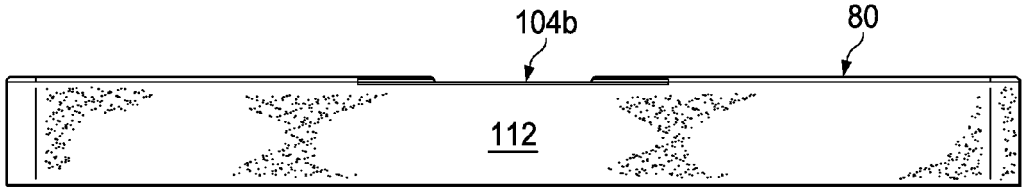
FIG. 13 is a side view of the tray of FIG. 11.

FIG. 12 shows an end view of tray 80. In some embodiments, the height of the exterior wall 112 is designed to be greater than or equal to the depth of the primary recessed portion 102. FIG. 13 illustrates a side view of tray 80. This view shows the slight depth of the recessed surface area 104*b*. This recessed surface area corresponds to where the information indicator 82 is placed when held by the tray 80. In some embodiments, the tapered width of the recessed surface area 104*b* is substantially equal to the tapered width of the portion of the indicator 82 that is to be placed into the recessed surface area 104*b*.

Figure 14:
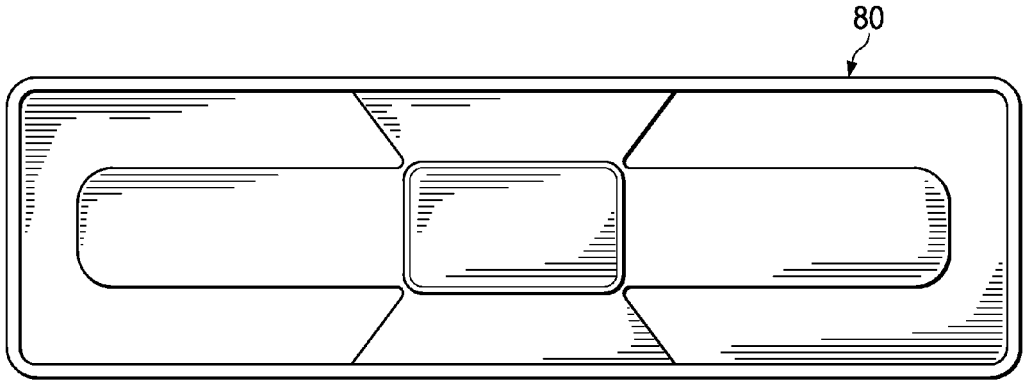
FIG. 14 is a plan view of the bottom of the tray of FIG. 11.

FIG. 14 illustrates a plan view of the bottom of the tray 80. This embodiment is shown to be a hollow, molded piece of semi-rigid material. It advantageous for an embodiment to take on this characteristic, as this hollow configuration provides the benefit of reduced weight and lower material costs. However, in some embodiments the tray 80 may be composed of a solid piece of material. It is to be appreciated that the tray 80 can be molded into various shapes and forms, depending on the shape of the product to be held in the tray 80. For example, the tray 80 may be circular, octagonal, or oval in shape to match a device of approximately the same shape.

Figure 15:
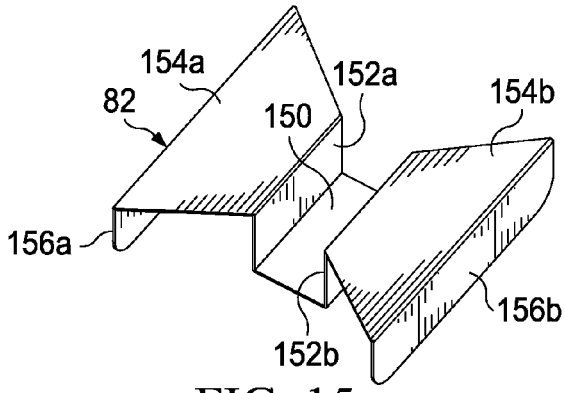
FIG. 15 is a perspective view of the second embodiment of the information indicator of the present application.

FIG. 15 is a perspective view of the information indicator 82. In some embodiments the indicator 82 is constructed of a single piece of foldable-material capable of displaying information. Such material can be paper-based, such as cardboard, or could also be a plastic or plastic-like substance. In some embodiments, the information indicator 82 comprises a rectangular recessed bottom section 150 and two rectangular side sections 152*a* and 152*b*. The indicator material is creased along the shared side of the rectangular recessed bottom section 150 and each of the rectangular side sections 152*a* and 152*b*, allowing the rectangular side sections 152*a* and 152*b* to be folded upwards at substantially a right-angle from the rectangular recessed bottom section 150. In some embodiments, this foldable portion of the indicator, 150, 152*a* and 152*b*, will fit into the primary recessed portion 102 of the tray 80. Specifically, the rectangular recessed bottom section 150 of the indicator 82 will align with and rest inside of the further recessed area 110 of the tray 80. As mentioned previously, the primary recessed portion 102 of the tray 80 may have an tapered cross-sectional profile rather than a rectangular profile. In this embodiment, the bottom section 150 and the side sections 152*a* and 152*b* would have a cross sectional profile that is tapered, rather than rectangular as shown in FIGS. 15 and 11. This embodiment would provide additional security against movement of a device placed in the primary recessed portion 102.

In some embodiments, the indicator 82 is further comprised of two surface tabs 154*a* and 154*b*. When the indicator 82 is placed into the possession of the tray 80, each of the two surface tabs 154*a* and 154*b* will rest in one of the recessed surface areas 104*a* and 104*b*, respectively. Thus, in some embodiments, the shape of the surface tabs 154*a* and 154*b* will substantially match the shape of the recessed surface areas 104*a* and 104*b*. This serves to further secure the indicator 82 from shifting or sliding when placed into the tray 80. And, as mentioned previously, the two surface tabs 154*a* and 154*b* may have a rectangular shape rather than a trapezoidal shape. The indicator material is creased along the shared side of the rectangular side sections 152*a* and 152*b* and the surface tabs 154*a* and 154*b*, allowing the surface tabs 154*a* and 154*b* to rest flat against the recessed surface areas 104*a* and 104*b* when the indicator 82 is placed into the tray 80.

In some embodiments, the flap portion of the indicator 82, including the surface tabs 154*a* and 154*b*, is further comprised of two exterior side flaps 156*a* and 156*b*. The indicator material is creased along the shared side of the surface tabs 154*a* and 154*b* and the exterior side flaps 156*a* and 156*b*, allowing the exterior side flaps 156*a* and 156*b* to be folded downward and rest flat against the exterior wall 112 of the tray 80 when the indicator 82 is placed into the tray 80. When the tray 80 is place into box 84, the exterior side flaps 156*a* and 156*b* serve to further secure the indicator 82 flush against the surface of the tray 80. This is accomplished because the exterior side flaps 156*a* and 156*b* are folded in to fit between the exterior wall 112 of the tray and the interior surface of the box 84. The configuration of the indicator 82 should be understood to be complementary to the tray 80 and thus provide a secure fit when the indicator 82 is placed into the tray.

Like the first embodiment of the indicator 60, the information indicator 82 allows for easier removal of the product from the tray 80 as explained in reference to FIG. 10. In some embodiments, the information indicator 82 can also serve to provide information to the consumer. All sections of the information indicator 82 can be printed with information useful to the consumer such as the manufacturer name or logo, product name or logo, product features, and advertisements. One of the benefits of the configuration of this embodiment of the indicator 82 is that any information printed on the surface tabs 154*a* and 154*b* is still visible when the product is placed into the tray 80 on top of the indicator 82 and can therefore convey a message or information to the viewer with the product still in the tray 80.

Figure 16:
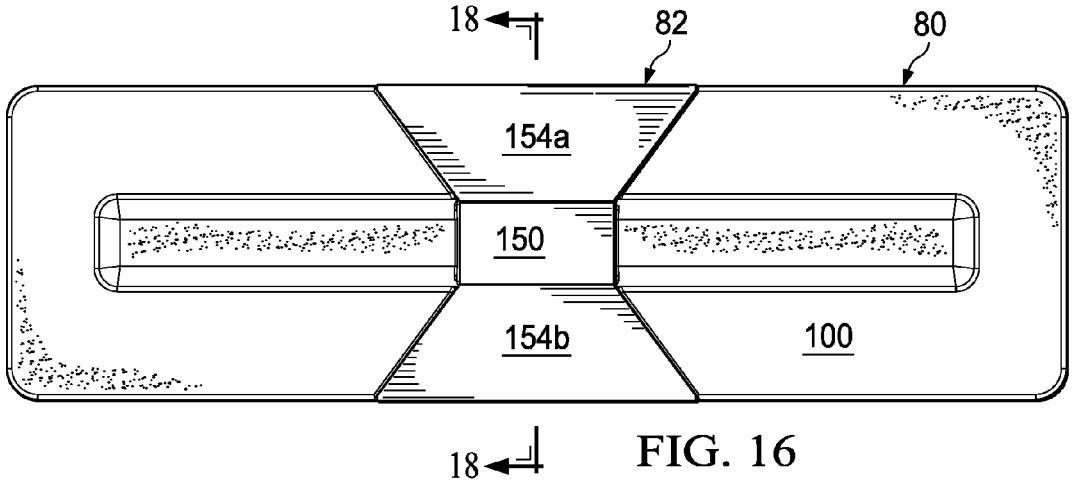
FIG. 16 is a plan view of the top of the tray of FIG. 11 with the information indicator of FIG. 15 being held by the tray.
Figure 16A:
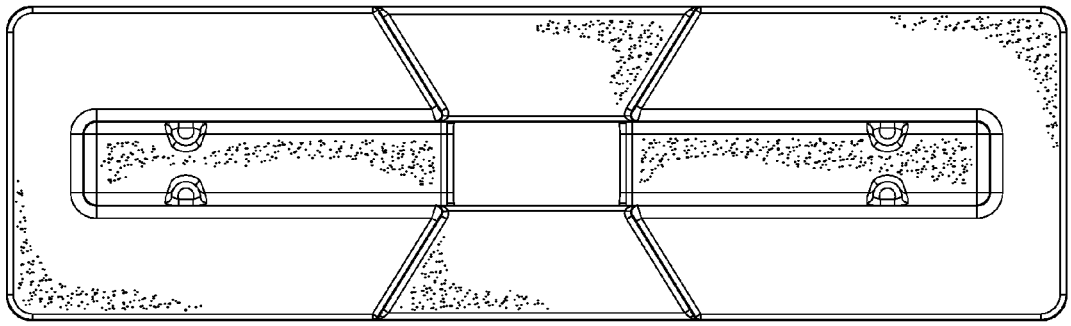
FIG. 16*a* is a perspective view of another exemplary embodiment of a tray having male detents, in accordance with the present disclosure.

FIG. 16 is a plan view of the top of the tray 80 holding the indicator 82. This view illustrates the visibility of the surface tabs 154*a* and 154*b* and the rectangular recessed bottom section 150 of the indicator 82 when the indicator 82 is held by the tray 80. Thus the indicator 82 could be printed with information to be viewed by the consumer when the product is not held in the tray 80. Surface tabs 154*a* and 154*b* would be visible when either the product was placed into the tray or removed from the tray 80.

Figure 17:
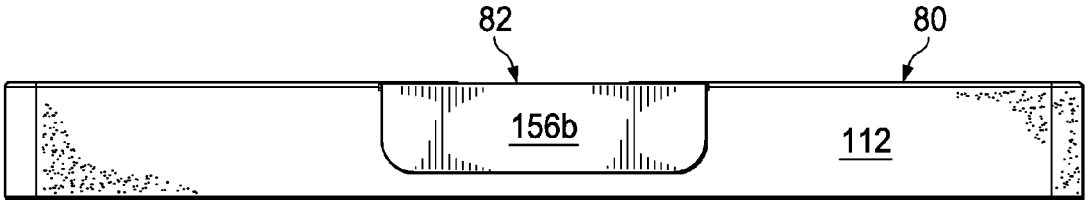
FIG. 17 is a side view of the tray and information indicator assembly of FIG. 16.

FIG. 17 illustrates a side view of tray 80 when indicator 82 is placed into the tray 80. In some embodiments, exterior side flap 156*b* of indicator 82 will be folded flat against exterior wall 112. This configuration helps to secure the indicator 82 against the surface of the tray 80. Specifically, when the tray 80 holding the indicator 82 is placed into box 84 the exterior side flaps 156*a* and 156*b* will be secured between the tray 80 and the box 84, thus further helping to hold the indicator 82 in place. In such embodiments, the depth of the exterior side flaps 156*a* and 156*b* are less than or equal to the depth of the exterior wall 112.

Figure 18:
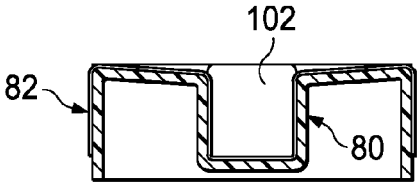
FIG. 18 is a cross-sectional view taken along the line 18-18 of FIG. 16.
Figure 18A:
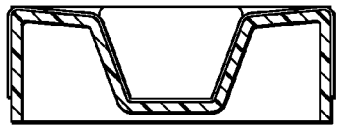
FIG. 18*a* is a cross-sectional view of an exemplary embodiment of a tray having a tapered cross-section, in accordance with the present disclosure.

FIG. 18 shows a cross-sectional view of the indicator 82 held in the tray 80 of FIG. 16 along the line 18-18. This view illustrates how in some embodiments the indicator 82 rests flush on all sides against the surfaces of the tray 80. The tray

80 is indicated by the striped area and the indicator 82 is indicated by the thin outline of the indicator located on top of the tray 80. It is understood that in some embodiments the product to be stored or displayed in the tray 80 would be placed into the primary recessed portion 102 on top of the portion of the indicator 82 held in the primary recessed portion of the tray 80.

It should be appreciated that the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A product package operable to store and display a device, comprising:

a tray having a recessed portion defined therein, the recessed portion comprising:

a bottom surface;

first and second sidewalls extending orthogonally from opposite sides of the bottom surface, the first and second sidewalls having a height equal to or greater than the thickness of the device;

first and second end walls extending from opposite ends of the bottom surface, wherein the first and second end walls connect the first and second sidewalls and have an interior surface that extends angularly from the bottom surface, such that the interior surface has a trapezoidal shape; and an information indicator coupled to the tray, wherein at least one portion of the information indicator is fitted within the recessed portion, and wherein the information indicator comprises:

a rectangular portion having outer dimensions such that the rectangular portion can be securely placed within the recessed portion; and first and second end tabs connected to the rectangular portion, the first and second end tabs having dimensions that extend from within the recessed portion to outside of the recessed portion when the rectangular portion is placed within the recessed portion;

wherein the first and second end tabs have a shape that corresponds to the trapezoidal shape of the interior surface of the first and second end walls.

2. The product package of claim 1, wherein the device is rectangular shaped, and the bottom surface has length and width substantially matching the length and width of the device.

3. The product package of claim 1, wherein the first and second end walls further comprise:

a first and second interior end wall, each having an upper and lower edge, wherein the lower edge of each is connected to opposite ends of the bottom surface; and a first and second exterior end wall, each having an upper edge and a lower edge, wherein the upper edge of the first exterior end wall connects to the upper edge of the first interior end wall, and the upper edge of the second exterior end wall is connected to the upper edge of the second interior end wall.

4. The product package of claim 1, wherein the product package further comprises a box having inner dimensions that substantially correspond to outer dimensions of the tray such that the tray can be securely placed in the box.

5. The product package of claim 4, wherein the box further comprises a top portion and a bottom portion, wherein the top portion forms a cover that may be placed on the bottom portion, thereby forming an enclosure around the tray.

6. The product package of claim 1, wherein the upper surface of the tray is covered in a layer of pliable material.

7. The product package of claim 1, wherein at least one of the first and second sidewalls comprises at least one groove defined therein, said groove being operable to receive a removal tool.

8. The product package of claim 1, wherein at least one of the first and second end walls comprises one or more indentations defined in the exterior surface of the at least one of the first and second end walls.

9. The product package of claim 1, wherein the information indicator is constructed of a foldable material.

10. The product package of claim 1 wherein the first and second sidewalls further comprise one or more protruding ridges.

11. The product package of claim 1 wherein the device is a lighter.

* * * * *